US006583711B2

(12) United States Patent
Yang

(10) Patent No.: US 6,583,711 B2
(45) Date of Patent: Jun. 24, 2003

(54) TEMPERATURE SENSITIVE CIRCUIT BREAKER

(76) Inventor: Chin-Chi Yang, No. 46, Lane 228, Ho-Ping St., Taichung (TW)

( * ) Notice: Subject to any disclaimer, the term of this patent is extended or adjusted under 35 U.S.C. 154(b) by 44 days.

(21) Appl. No.: 10/008,698

(22) Filed: Nov. 8, 2001

(65) Prior Publication Data

US 2003/0085792 A1 May 8, 2003

(51) Int. Cl.[7] ..... H01H 71/18; H01H 71/20

(52) U.S. Cl. ..... 337/394; 337/393; 337/382; 337/123; 337/4

(58) Field of Search ..... 337/1, 2, 4, 5, 337/6, 123, 382, 393, 383, 394; 29/623

(56) References Cited

U.S. PATENT DOCUMENTS 661,555 A * 11/1900 Ross ..... 337/306
2,809,523 A * 10/1957 Burling et al. ..... 73/335.06
3,594,674 A * 7/1971 Willson ..... 337/139
3,634,803 A * 1/1972 Willson et al. ..... 337/123
4,642,599 A * 2/1987 Saur ..... 337/397
5,014,036 A * 5/1991 Komoto ..... 337/407
5,159,309 A * 10/1992 Bayer ..... 337/402
5,831,507 A * 11/1998 Kasamatsu et al. ..... 337/4

FOREIGN PATENT DOCUMENTS

GB 2071913 A * 9/1981 ..... H01H/37/20

* cited by examiner

*Primary Examiner*—Anatoly Vortman
(74) *Attorney, Agent, or Firm*—Dellett and Walters

(57) ABSTRACT

A temperature sensitive circuit breaker includes two contacts electrically mounted on a circuit board and an insulating pivot seat attached to the circuit board between the two contacts. A lever has a first end pivotally connected to the pivot seat and connected to one of the contacts, and a second end electrically connected to the other contact. A non-metallic expansive rod is mounted on the circuit board below the lever to push the lever upward to make the second end of lever separate from the contact when a high temperature on the circuit board is transferred to the expansive rod. The breaking member causes a high temperature to melt itself when a current passes through the breaking member to open a circuit on the circuit board.

8 Claims, 6 Drawing Sheets

TEMPERATURE SENSITIVE CIRCUIT BREAKER

BACKGROUND OF THE INVENTION

1. Field of the Invention

The present invention relates to a circuit breaker, and more particularly to a temperature sensitive circuit breaker that opens the circuit when a high temperature condition or a current overload exists.

2. Description of Related Art

With reference to FIG. 6, a conventional circuit breaker in accordance with the prior art comprises a base (50), a core (53), two U-shaped rails (54), two prongs (55), a connector (60), a first spring (64) and a second spring (65). A cavity (51) centrally defined in the base (50) and extending to the top of the base (50). A chamber (52) is defined in the base (50) and communicates with the cavity (51). The core (53) is secured in the cavity (51) and made of meltable material so that the core (53) will melt and the melted material will flow into the chamber (52) due to a high temperature caused by a current overload. The U-shaped rails (54) are attached perpendicularly to the top of the base (50) on diametrically opposite sides of the cavity (51). Each rail (54) has a slot (not shown) defined in the bottom of the rail (54) aligning with and facing the slot in the other rail (54). The prongs (55) extend through the base (50), and part of each prong (55) is embedded in tile base (50). A convex contact (551) is formed on a first end of each prong (55) and aligns with the slot in the rail (54). A second end of each prong (55) is electrically connected to the circuit.

The connector (60) is electrically connected between the two prongs (55) and comprises two slides (61), a bridge (62) and a rod (63). The slides (61) are respectively slidably mounted in the U-shaped rails (54). Each slide (61) has a first side (not numbered) abutting the contract (551) on the prong (55) and a second side (not numbered) electrically connected to a bridge (62) so that the two prongs (55) are electrically connected to each other. The rod (63) has a first end attached to the bottom of the bridge (62) and a second end securely inserted into the core (53). The first spring (64) mounted around the rod (63) and is compressed between the top of the base (50) and the bottom of the bridge (62). A second spring (65) has first end attached to the top of the bridge (62) and a second end attached to the casing (70) so the second spring (65) is stretched between the bridge (62) and the casing (70).

With reference to FIG. 7, when the circuit (not shown) to which the breaker is attached has a current overload and a resultant high temperature, the core (53) melts and flows into the chamber (52). This frees the rod (53) from the core (53), and restitution force in the first and second springs (64, 65) detach the bridge (62) from the rail (54). Then the circuit to which the breaker is attached is broken because the two prongs (55) are disconnected from each other.

The conventional circuit breaker breaks the circuit only when the circuit has a high temperature that is caused by an overload current. However, a current overload does not necessarily cause a high temperature so that the current overload may damage the circuit. Furthermore, the conventional circuit breaker comprises many small elements, such as the rod (63) and the two springs (64, 65) that are hard to assemble in the casing (70), and conventional circuit breaker can only be used one time because the core (53) can not be restored to its original configuration after being melted.

The present invention has arisen to mitigate and/or obviate the disadvantages of the conventional circuit breaker.

SUMMARY OF THE INVENTION

The main objective of the present invention is to provide a simpler circuit breaker that opens the circuit to which it is attached whatever a high temperature or a current overload in the circuit.

To achieve tile objective, the circuit breaker in accordance with the present invention comprises two contacts electrically mounted on a circuit board and an insulating pivot seat attached to the circuit board between the two contacts. A lever has a first end pivotally connected to the pivot seat and connected to one of the contact and a second end electrically connected to the other contact. A non-metallic expansive rod is mounted on the circuit board below the lever to push the lever upwardly to make the second end of lever disconnect from the contact when a high temperature in the circuit is transferred to the expansive rod. A breaking member is connected between a second end of the lever and the other contact on the circuit board. A high temperature associated with a current overload causes the breaking member to melt and open a circuit to which the breaker is attached.

Further benefits and advantages of the present invention will become apparent after a careful reading of the detailed description with appropriate reference to the accompanying drawings.

DETAILED DESCRIPTION OF THE INVENTION

Figure 1:
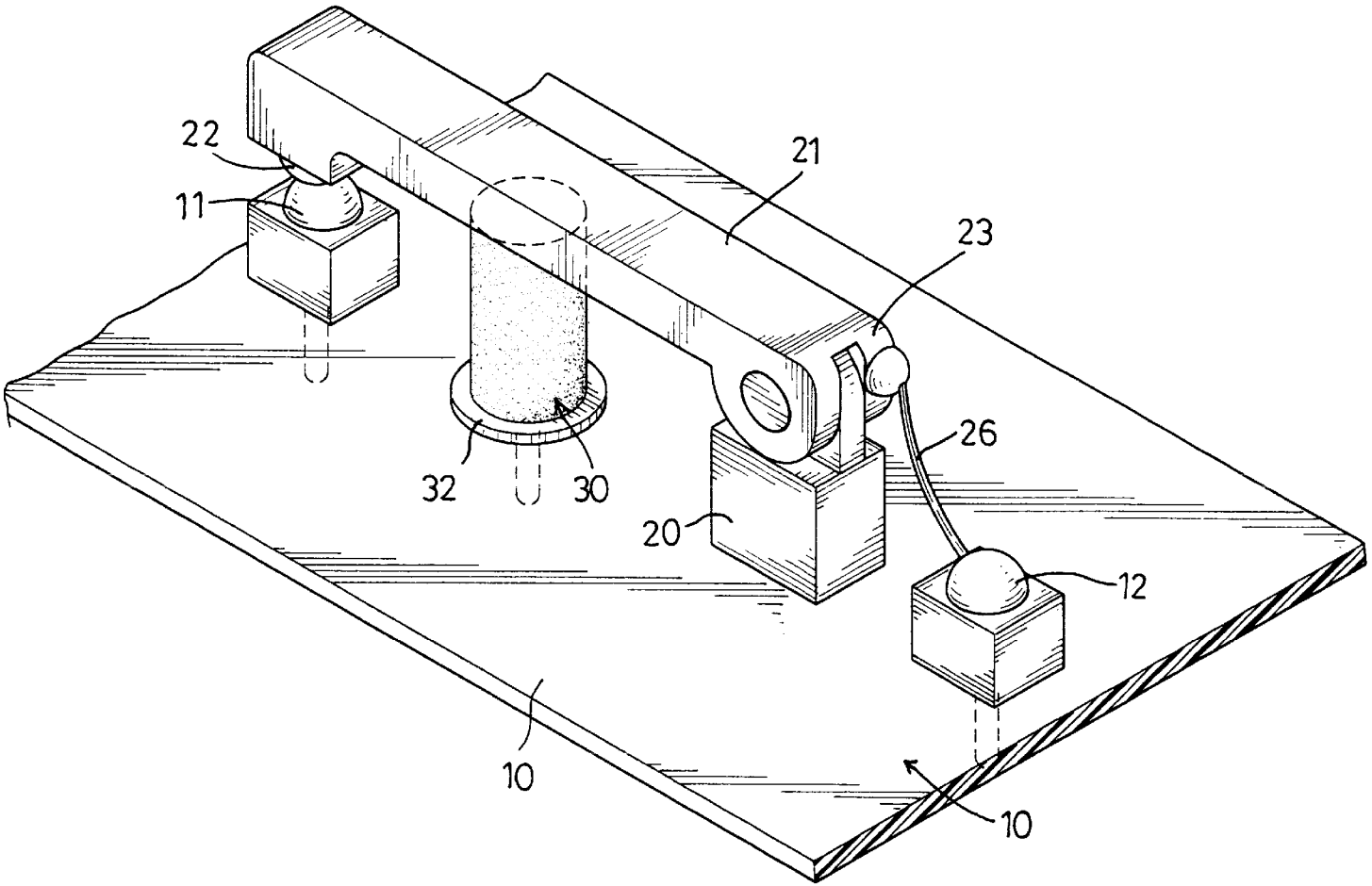
FIG. 1 is a perspective view of a circuit breaker in accordance with the present invention.

With reference to the drawings and initially to FIG. 1, a circuit breaker in accordance with the present invention is adapted to be mounted on a circuit board (10) and comprises a first contact (11), a second contact (12), a lever (21), an insulating pivot seat (20) and a non-metallic expansive rod (30). The lever (21) electrically connects the two contracts (11, 12). The non-metallic expansive rod (30) is adapted to be mounted on the circuit board (10) below the lever (21).

Each contact (11, 12) is adapted to be electrically connected to an open point (not shown) of a circuit on the circuit board (10). The insulating pivot seat (20) is attached to the circuit board (10) between the two contacts (11, 12). The lever (21) has a first end (23) pivotally attached to the insulating pivot seat (20) and a second end (22) electrically connected to the first contact (11). The second contact (12) is electrically connected to a contact (24) formed on the first end (23) of the lever (21) by a breaking member (26) so that the first contact (11) and the second contact (12) are electrically connected to each other via the breaking member (26) and the lever (21), and the circuit on the circuit board (10) is closed. In the preferred embodiment of the present invention, the breaking member (26) is a wire fuse.

The non-metallic expansive rod (30) has a first end abutting the bottom of the lever (21) and a second end attached to a sense plate (32) that is securely attached to the circuit board (10) to transfer heat to the non-metallic expansive rod (30). In the preferred embodiment of the present invention, the non-metallic expansive rod (30) is made of polypropylene (PP) or polyester (PE) that has a high expansion coefficient so that the expensive rod (30) will quickly expand when the heat of the circuit board (10) is transferred via tile sense plate (32) to the non-metallic expansive rod (30).

Figure 2:
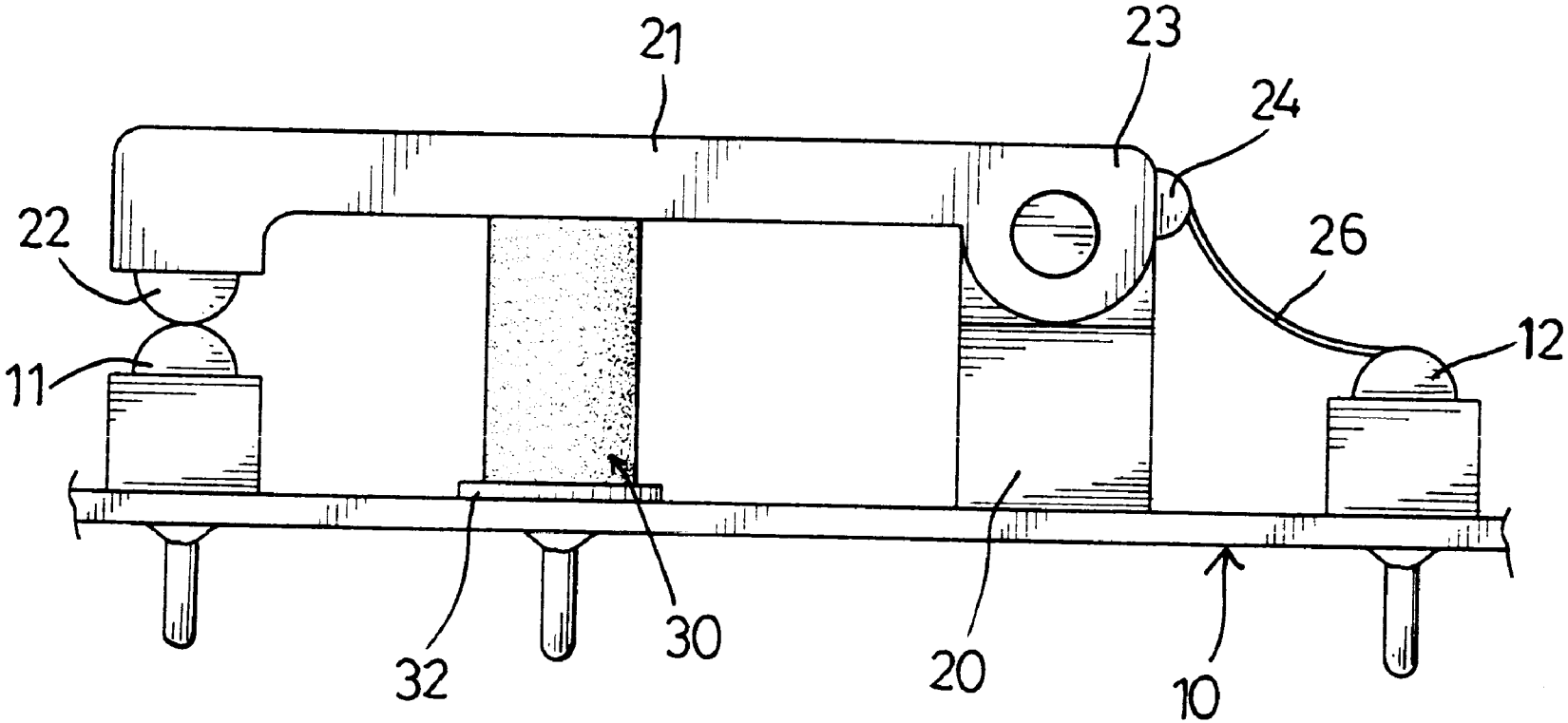
FIG. 2 is a side plan view of the circuit breaker in FIG. 1.

With reference to FIG. 2, the first contact (11) is mounted on the second end (22) of the lever (21), and the contact (24) on the first end (23) of the lever (12) and the second contact (12) on the circuit board (10) are connected to each other by the breaking member (26) so the circuit on the circuit board (10) is closed.

Figure 3:
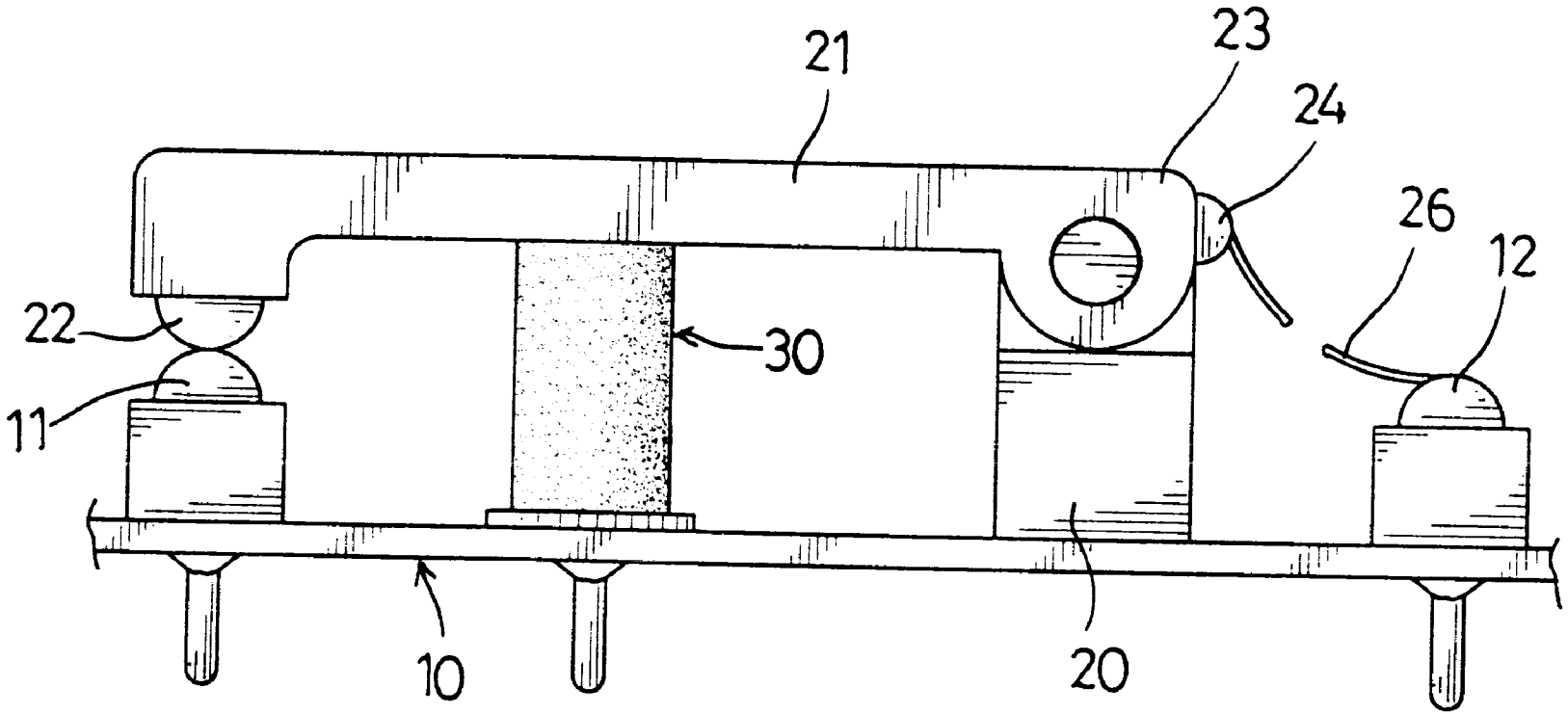
FIG. 3 is a side plan view of the circuit breaker in FIG. 1 showing how the circuit opened due to a current overload.

With reference to FIG. 3, when the circuit board (10) has a current overload, the breaking member (26) will cause a high temperature to melt the breaking member (26) when the overload current passes through the breaking member (26) so that the circuit on the circuit board (10) is opened. Consequently, the circuit breaker can effectively open the circuit when a current overload occurs on the circuit board (10).

Figure 4:
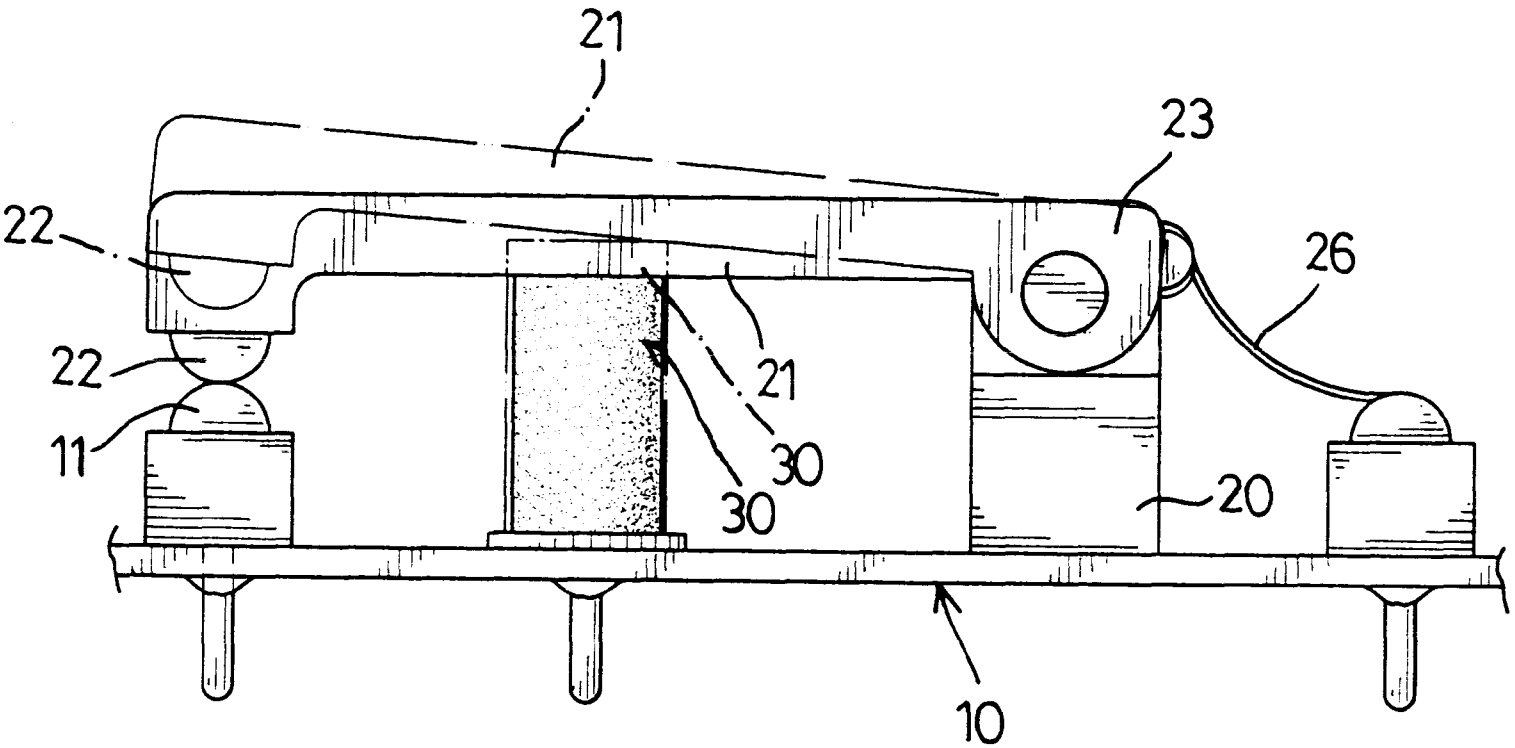
FIG. 4 is a side plan view of the circuit breaker in FIG. 1 showing how the circuit opened due to a high temperature.

With reference to FIG. 4, when a high temperature condition occurs on the circuit board, the non-metallic expansive rod (30) expands to push the lever (21) upwardly when the high temperature of tile circuit board (10) is transferred to the non-metallic expansive rod (30) via the sense plate (32). The second end (22) of the lever (21) is pushed away from the first contact (11), and the circuit of the circuit board (10) is opened. When the high temperature diminishes, the non-metallic expansive rod (30) will shrink so the lever (21) move downward to make the second end (22) of the lever (21) contract the first contact (11) again. Consequently, the circuit of the circuit board (10) is restored when the high temperature on the circuit board (10) no long exists.

Figure 5:
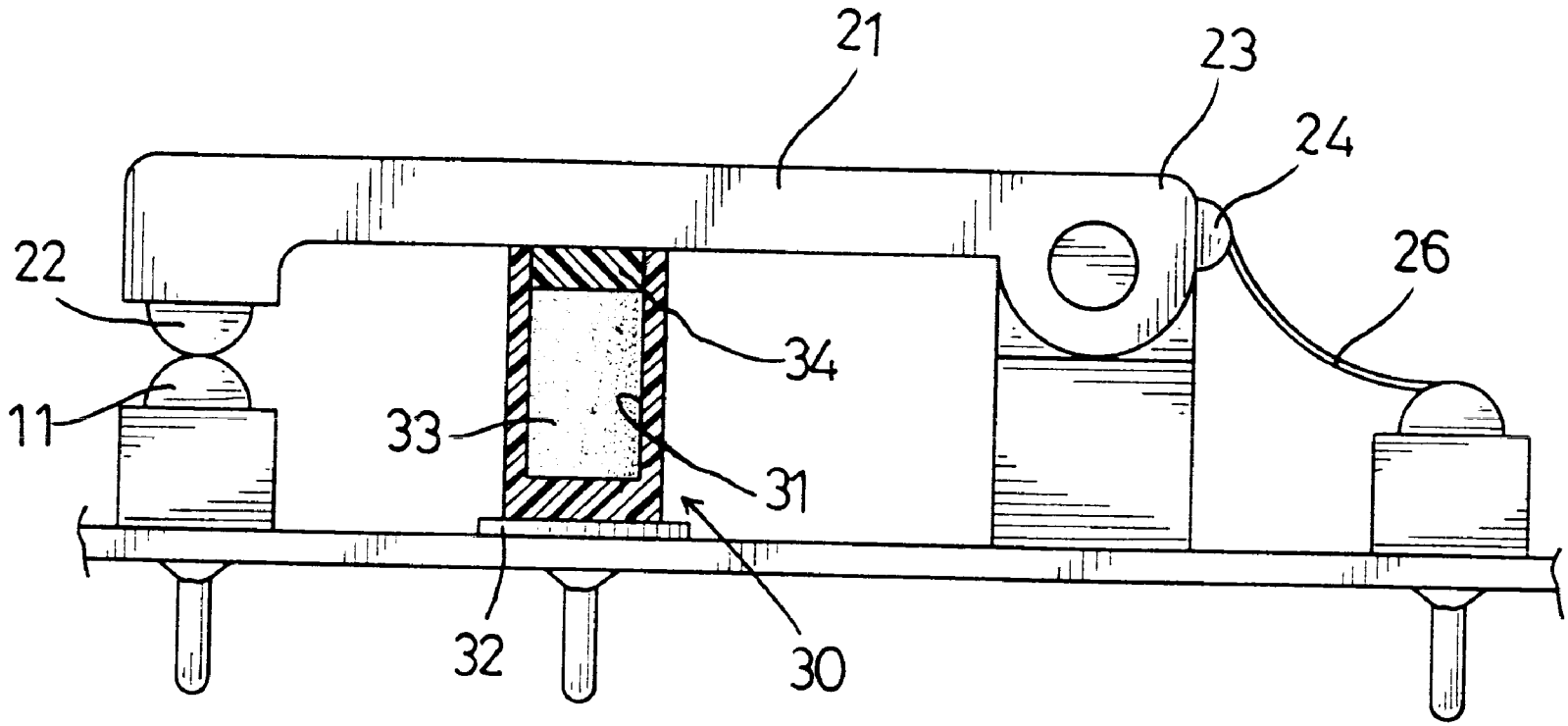
FIG. 5 is a side plan view in partial section of another embodiment of the circuit breaker in accordance with the present invention.
Figure 7:
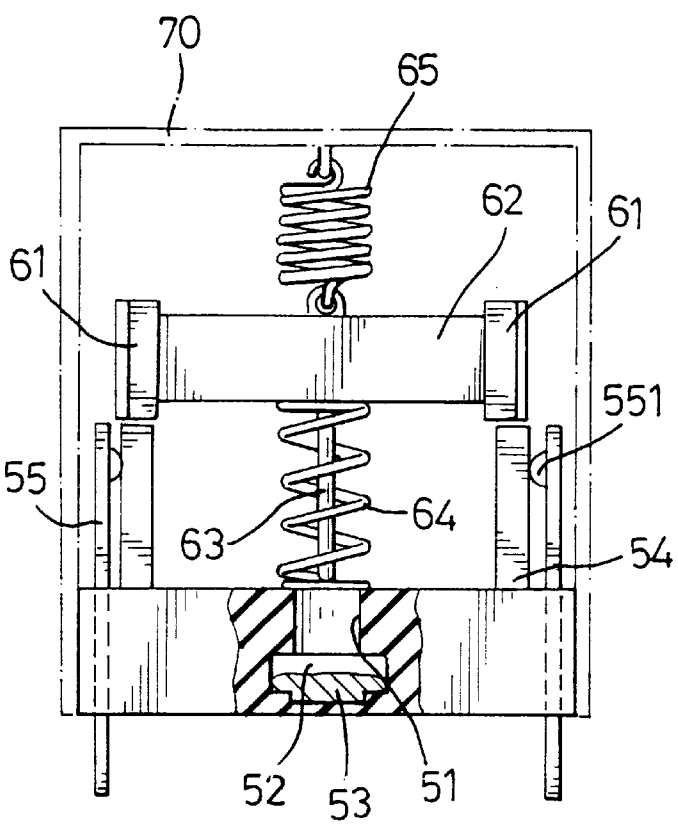
FIG. 7 PRIOR ART
FIG. 7 is an operational side plan view of the circuit breaker in FIG. 6.
Figure 6:
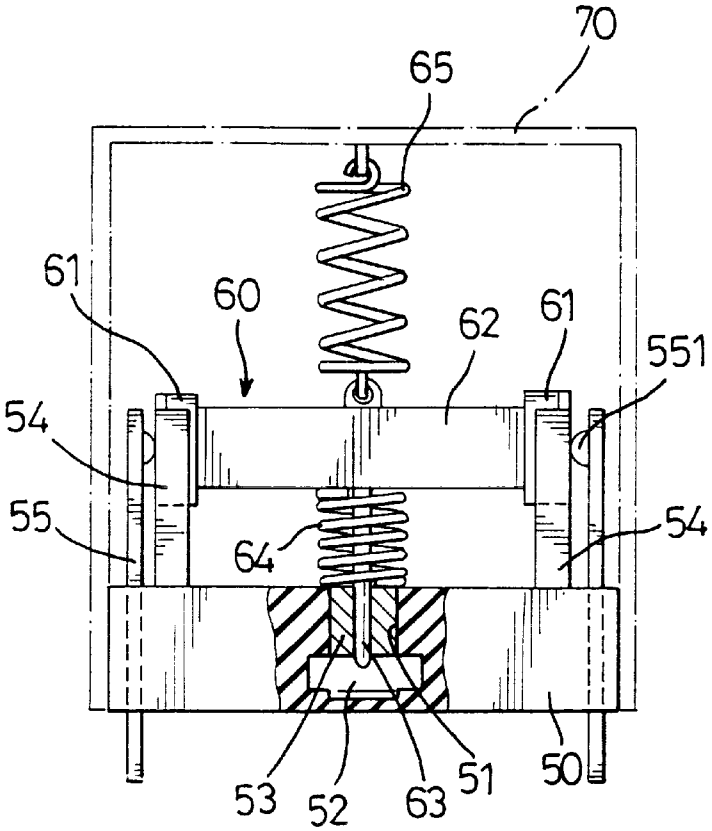
FIG. 6 PRIOR ART
FIG. 6 is a side plan view of a conventional circuit breaker in accordance with the prior art.

With reference to FIG. 5, another embodiment of the non-metallic expansive rod (30) in accordance with the present invention comprises a cavity (31) defined to receive a filler (33) in the non-metallic expansive rod (30), and a cover (34) securely attached to the top of the cylinder (31) to close the cylinder (31) and hold the filler (33) in place. The filler (33) can be a gas or liquid that have an expansion coefficient greater than that of the cylinder (31) so that the non-metal expansive rod (30) is more sensitive to the temperature of the circuit board and expands more quickly.

The circuit breaker has the following advantages.

1. The circuit breaker can disrupt the circuit whatever a high temperature or a overload exists on the circuit board so that the circuit breaker can protect the circuit of the circuit board more thoroughly.
2. The non-metallic expansive rod will shrink to the original shape when the high temperature vanishes so that if the circuit board only has a high temperature, the circuit breaker can be used many times and does not need to be replaced.
3. The structure of the circuit breaker is simplified and easily assembled.

Although the invention has been explained in relation to its preferred embodiment, it is to be understood that many other possible modifications and variations can be made without departing from the spirit and scope of the invention as hereinafter claimed.

What is claimed is:

1. A temperature sensitive circuit breaker adapted to be mounted on a circuit board and comprising:

a first contact and a second contact respectively adapted to be electrically mounted on a circuit board;

an insulating pivot seat adapted to be mounted on the circuit board and situated between the first contact and the second contact;

a lever having a first end pivotally connected to the insulating pivot seat and a second end selectively electrically connected to the first contact;

a breaking member having two opposite ends respectively electrically connected to the second contact and the first end of the lever; and a non-metallic expansive rod having a first end abutting a bottom of the lever and a second end attached to a sense plate that is adapted to be securely attached to the circuit board to transfer heat to the non-metallic expansive rod when the circuit board has a high temperature;

wherein the breaking member causes a high temperature to melt itself when a current overload passes through the breaking member to open a circuit on the circuit board and the non-metallic expansive rod expands to push the lever upward when a high temperature on the circuit board is transferred to the non-metallic expansive rod via the sense plate so that the second end of the lever is pushed away from the first contact and the return circuit of the circuit board is opened.

2. The temperature sensitive circuit breaker as claimed in claim 1, wherein the non-metallic expansive rod comprises a cavity defined to receive a filler in the non-metal expansive rod and a cover attached to a top of the non-metal expansive rod to close the cavity.

3. The temperature sensitive circuit breaker as claimed in claim 1, wherein the breaking member is a fuse.

4. The temperature sensitive circuit breaker as claimed in claim 2, wherein the breaking member is a fuse.

5. The temperature sensitive circuit breaker as claimed in claim 2, wherein the filler is gas.

6. The temperature sensitive circuit breaker as claimed in claim 2, wherein the filler is liquid.

7. The temperature sensitive circuit breaker as claimed in claim 4, wherein the filler is gas.

8. The temperature sensitive circuit breaker as claimed in claim 4, wherein the filler is liquid.

* * * * *